US009427056B2

(12) United States Patent
Nietvelt

(10) Patent No.: US 9,427,056 B2
(45) Date of Patent: Aug. 30, 2016

(54) PACKAGING FOR COLLECTOR CARDS

(71) Applicant: CARTAMUNDI TURNHOUT NV, Turnhout (BE)

(72) Inventor: Steven Nietvelt, Turnhout (BE)

(73) Assignee: CARTAMUNDI TURNHOUT NV, Turnhout (BE)

( * ) Notice: Subject to any disclaimer, the term of this patent is extended or adjusted under 35 U.S.C. 154(b) by 0 days.

(21) Appl. No.: 14/349,851

(22) PCT Filed: Oct. 2, 2012

(86) PCT No.: PCT/EP2012/069486

§ 371 (c)(1),
(2) Date: Apr. 4, 2014

(87) PCT Pub. No.: WO2013/050380

PCT Pub. Date: Apr. 11, 2013

(65) Prior Publication Data

US 2014/0231293 A1 Aug. 21, 2014

(30) Foreign Application Priority Data

Oct. 4, 2011 (EP) ..... 11183823

(51) Int. Cl.

| | |
|---|---|
| ***B65D 85/48*** | (2006.01) |
| ***A45C 11/00*** | (2006.01) |
| ***B65D 75/14*** | (2006.01) |
| ***B65D 5/20*** | (2006.01) |

(Continued)

(52) U.S. Cl.

CPC ..... *A45C 11/00* (2013.01); *B65B 49/14* (2013.01); *B65D 5/2076* (2013.01); *B65D 5/4208* (2013.01); *B65D 5/4229* (2013.01); *B65D 75/14* (2013.01)

(58) Field of Classification Search

CPC .... B65D 75/14; B65D 5/2076; B65D 49/14; B65D 5/4229; B65D 5/4208

USPC ..... 206/37–39, 39.1, 39.7, 424, 425, 449, 206/461, 525.1, 806; 53/452, 467; 229/87.01, 87.18, 87.19, 101, 103.2; 493/121, 128, 162, 183

See application file for complete search history.

(56) References Cited

U.S. PATENT DOCUMENTS 646,638 A * 4/1900 Cutler ..... B65D 27/00 229/101
811,489 A * 1/1906 Dunwell ..... 206/39

(Continued)

FOREIGN PATENT DOCUMENTS

| | | |
|---|---|---|
| DE | 29504410 U1 | 5/1995 |
| DE | 19641405 A1 | 4/1998 |
| EP | 0028693 A1 | 5/1981 |

OTHER PUBLICATIONS

International Search Report for corresponding International PCT Application No. PCT/EP2012/069486, mailed Dec. 18, 2012.

*Primary Examiner* — Luan K Bui
(74) *Attorney, Agent, or Firm* — Workman Nydegger

(57) ABSTRACT

Collector card packaging assembly includes a packaging for collector cards manufactured from a single sheet of material. The collector card packaging assembly has s a limited number of collector cards, dimensioned and enclosed within the packaging such that the limited number of collector cards is positioned on top of the center part and below the upper flap, the lower flap, the first lateral flap and the second lateral flap.

19 Claims, 7 Drawing Sheets

(51) Int. Cl.
*B65D 5/42* (2006.01)
*B65B 49/14* (2006.01)

(56) References Cited

U.S. PATENT DOCUMENTS 1,125,535 A * 1/1915 Hoffman ..... B65D 5/0005 229/101
1,207,899 A * 12/1916 Greve ..... 206/424
1,221,884 A * 4/1917 Martin ..... B42F 7/06 229/101
1,515,639 A * 11/1924 Webb ..... B42F 7/06 229/101
1,780,136 A * 10/1930 Lee ..... 229/87.15
3,108,734 A * 10/1963 Hewko ..... 206/39
3,114,492 A * 12/1963 Engstrom ..... B65D 5/0005 206/425
3,368,735 A * 2/1968 Levi ..... 206/424
3,455,499 A * 7/1969 Anderson ..... B65D 5/0005 229/101
RE26,742 E * 12/1969 Laskow ..... 229/87.19
4,322,001 A * 3/1982 Hurley ..... 206/449
4,322,028 A * 3/1982 Kawahara ..... B65D 75/14 229/103.2
4,841,712 A 6/1989 Roou
6,044,848 A 4/2000 Huang
6,308,831 B1 * 10/2001 Saxe et al. ..... 206/449
7,127,844 B2 * 10/2006 Collins ..... 206/45.24
7,407,469 B2 * 8/2008 Lockhart ..... B42F 7/02 229/67.3
2008/0078816 A1 * 4/2008 Huang ..... 229/87.01

* cited by examiner

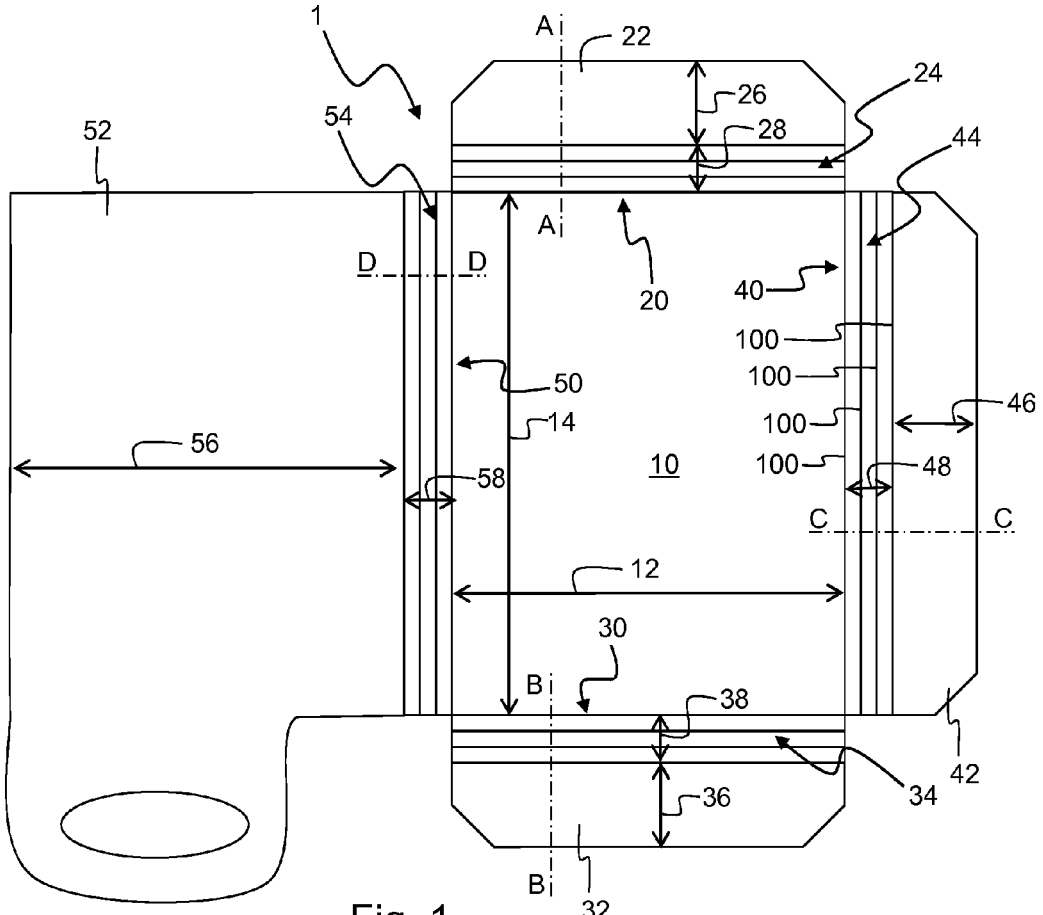
Fig. 1
Fig. 1A
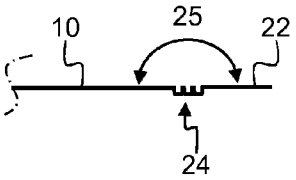
Fig. 1B
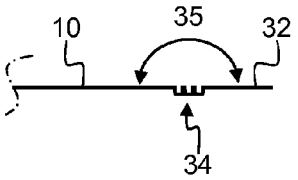
Fig. 1C
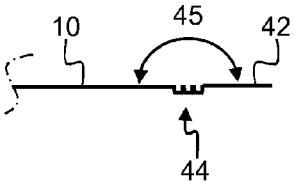
Fig. 1D
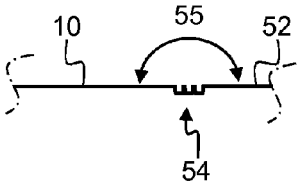

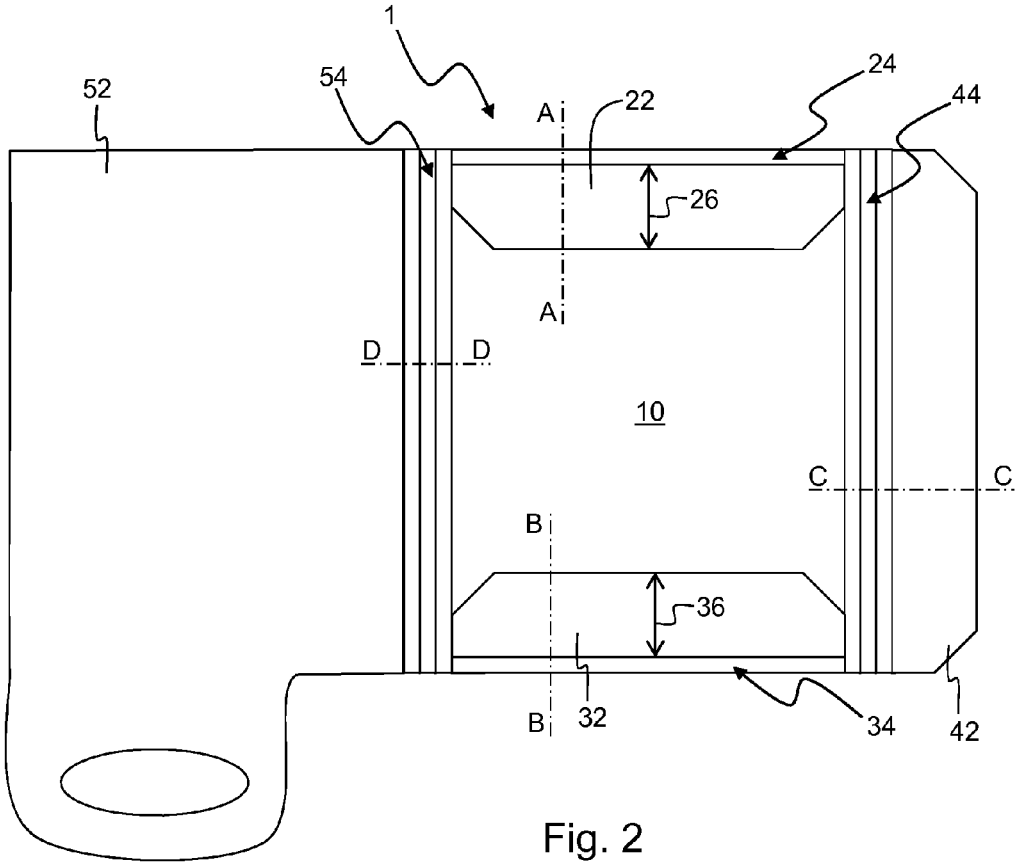
Fig. 2
Fig. 2A
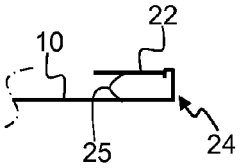
Fig. 2B
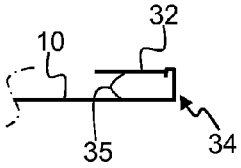
Fig. 2C
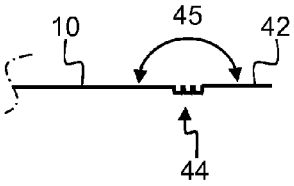
Fig. 2D
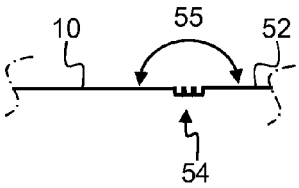

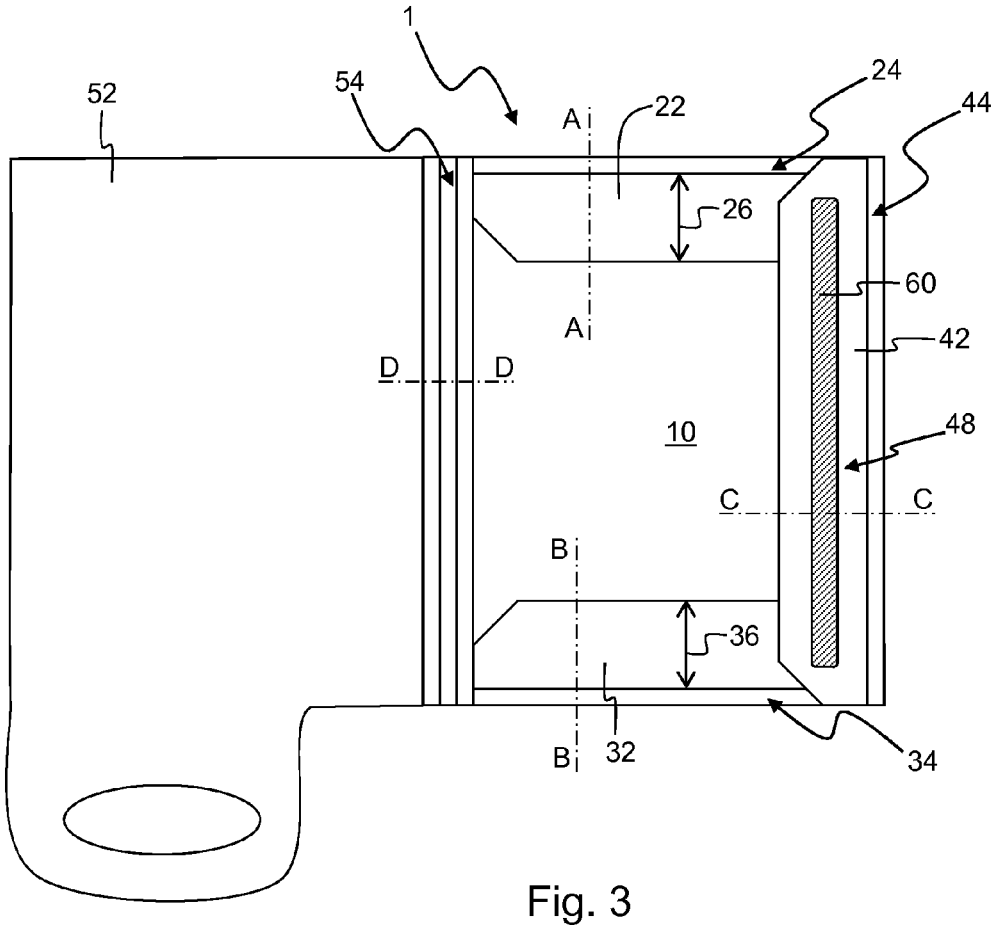
Fig. 3
Fig. 3A
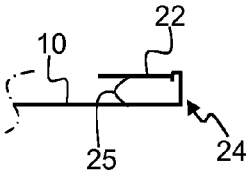
Fig. 3B
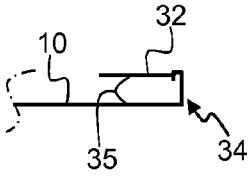
Fig. 3C
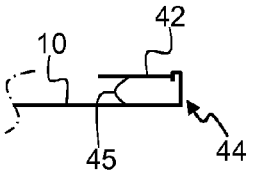
Fig. 3D
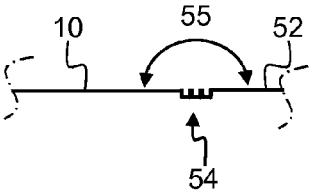

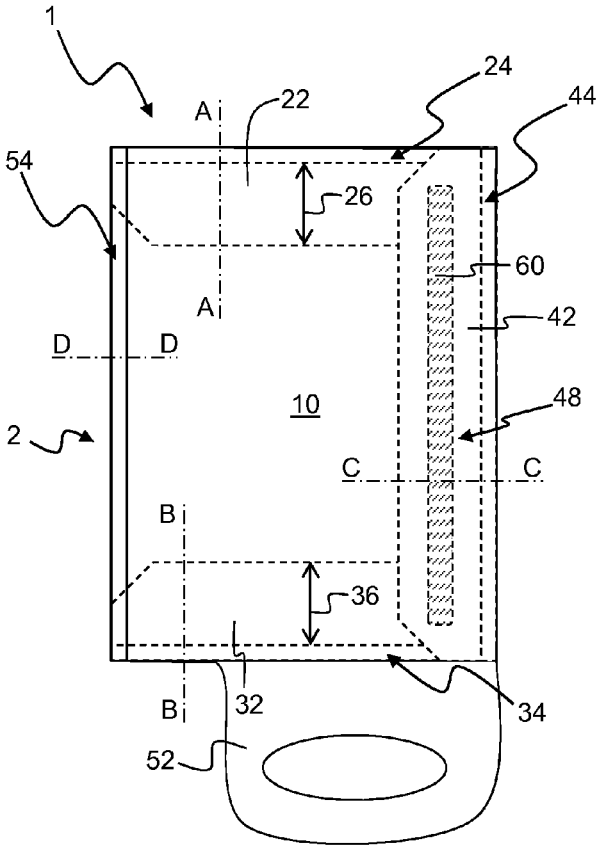
Fig. 4
Fig. 4A
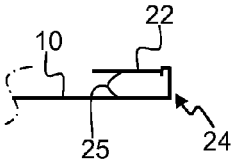
Fig. 4B
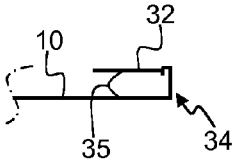
Fig. 4C
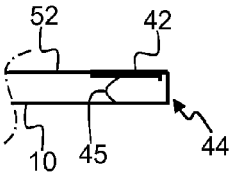
Fig. 4D
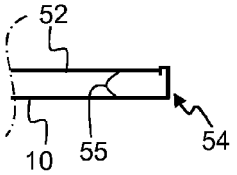

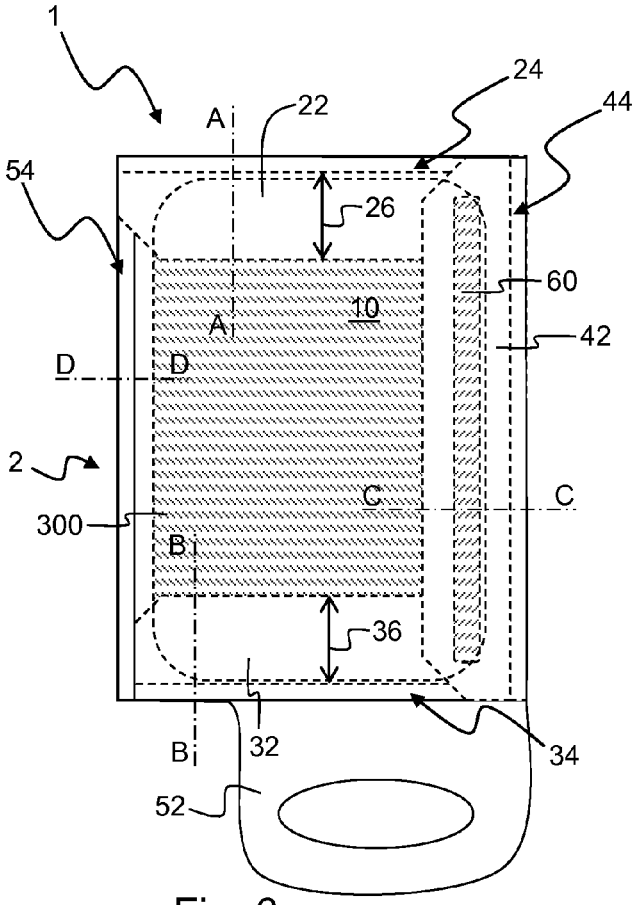
Fig. 6
Fig. 6A
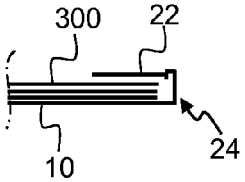
Fig. 6B
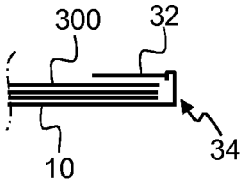
Fig. 6C
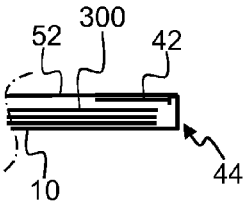
Fig. 6D
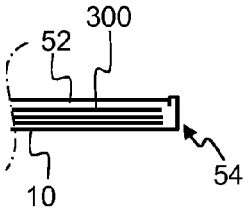

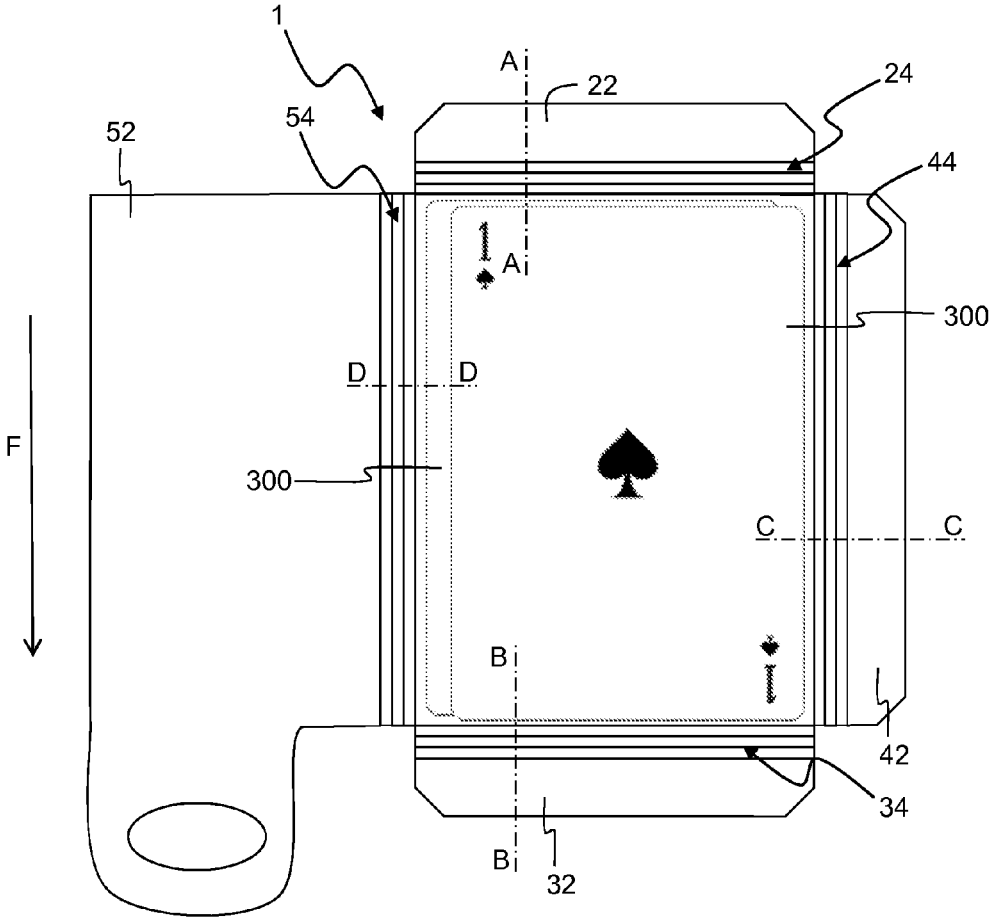
Fig. 7
Fig. 7A
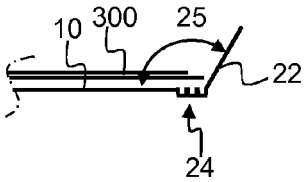
Fig. 7B
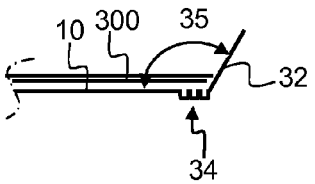
Fig. 7C
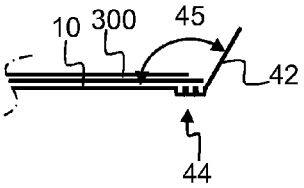
Fig. 7D
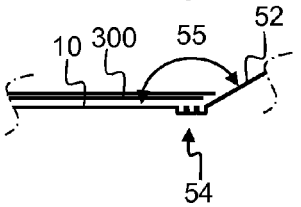

PACKAGING FOR COLLECTOR CARDS

FIELD OF THE INVENTION

The present invention generally relates to the packaging of collector cards.

BACKGROUND OF THE INVENTION

A trading card or collector card is a card, usually made out of cardboard or thick paper, which usually contains an image of a certain person, place or thing (fictional or real) and a short description of the picture, along with other text describing for example game features. There is wide variation among different types of collector cards as to the configuration of objects and the content on the card. Collector cards are traditionally associated with sports; football cards are especially well-known.

The packaging for these collector cards needs to fulfill specific requirements. These collector cards are usually retailed in package comprising a limited number of cards as opposed to a regular playing card set. Furthermore it is required that the retail packaging cannot be opened and closed without leaving traces in order to guarantee that the contents of the package was not altered before it is opened by the end consumer. Therefor a conventional packaging for a set of playing cards, usually in the form of a cardboard box that can be releasably opened, is not suitable for packaging such collector cards. Furthermore it is difficult, because of the conventional manufacturing process for introducing a set of playing cards into its packaging, there are lower limits to the number of cards that can be handled. The set of cards has to be introduced automatically into the preformed box shaped packaging through an open end at the top or the bottom and this can only be done reliably if this open end has certain minimum dimensions which correspond to the height of the stack of cards, such as for example about 20 mm.

A known type of packaging for collector cards, also called a flowpack, is a packaging for collector cards in a metallic film. The film is glued or thermo-sealed at the top and the bottom side as well as at the both lateral sides. Such packaging fulfils the above requirements, however it is delicate and there exists the risk of it being damaged inadvertently during manufacturing, display and handling. Furthermore tearing open the metallic film is not easy, the metallic film material is expensive and creates metallic waste. The metallic film packaging also needs to be pre-printed on dedicated printing machines before packaging the collector cards in it. U.S. Pat. No. 4,841,712 shows a method for manufacturing such a flow pack comprising collector cards. It is clear from this document that the throughput capacity for mass production of such packaging assemblies is limited especially because the packages need to be sealed, often by means of thermo-sealing or gluing in a direction transverse to the transport direction of the packages in order to seal of one protective pouch from the next. Furthermore this needs to be done in a way that is synchronised with the pre-printed content on the metallic film. These operations transverse to the transport direction of the manufacturing process and requiring delicate synchronisation limit the throughput capacity of such a manufacturing process and there exists the risk of damaging the collector cards, for example when they are not correctly aligned with the packaging.

These problems are partly solved by another type of packaging of collector cards comprising a cardboard packaging having a number of extractable cards with e.g. pictures of football players printed directly on the inner side of the cardboard packaging and surrounded for example by a perforated edge for easy extraction. The cardboard packaging is folded in two and at least one side is glued together to close the packaging such that the images on the extractable cards are not visible any more, the backside of the cards thus serving as a part of the outside of the packaging. Tearing off this closed side opens the packaging whereby the cards can be extracted along perforated edges.

The problem with this type of collector card packaging is that the cardboard packaging does not allow for a clean edge around the extractable cards as opposed to clean cut collector cards that are finished in the manufacturing plant. Furthermore luxurious quality collector cards are printed with a shiny foil-like quality which cannot be combined with features that allow easy extraction such as for example perforated edges. A further problem is that damage to this packaging directly results in damage to the extractable cards that are part of this packaging.

A further card packaging is known from EP0028693. It describes a card packaging as mentioned in the preamble of claim 1.

It is an object of the present invention to provide a packaging for collector cards that overcomes the problems of the prior art, allows for a more efficient manufacturing process and does not require a special purpose printing process and is well suited for a limited number of collector cards.

SUMMARY OF THE INVENTION

According to a first aspect of the invention, there is provided a collector card packaging assembly comprising a Packaging for collector cards, manufactured from a single sheet of material comprising:

A rectangular centre part with a circumference comprising an upper side, a lower side, a first lateral side and a second lateral side;

An upper flap connected to said upper side by means of an upper folding zone;

A lower flap connected to said lower side by means of a lower folding zone;

A first lateral flap connected to said first lateral side by means of a first lateral folding zone; and A second lateral flap connected to said second lateral side by means of a second lateral folding zone, said upper flap and lower flap being folded towards said rectangular centre part along said upper and lower folding zone respectively, said first lateral flap being folded towards said centre part along said first lateral folding zone, glue being provided to the side of said first lateral flap that faces away from said rectangular centre part, said second lateral flap being folded towards said centre part along said second lateral folding zone such that said second lateral flap contacts said side of said first lateral flap provided with glue, said first lateral flap and said second lateral flap being dimensioned such that, when folded on said centre part, they cover said centre part entirely; and Said upper flap and said lower flap being dimensioned such that the depth of said upper and lower flap exceeds the depth of said upper and lower folding zone respectively,

CHARACTERISED IN THAT the collector card packaging assembly further comprises a limited number of collector cards, dimensioned and enclosed within said packaging such that said limited number of collector cards is positioned on top of said centre part and below said upper flap, said lower flap, said first lateral flap and said second lateral flap.

The packaging assembly according to the invention allows for a packaging assembly that can be manufactured efficiently for a limited number of cards which is lower than the number of cards that can be packaged when they need to be introduced in a pre-formed, conventional card box as in that case there would not be sufficient clearance for introducing the collector cards reliably. Furthermore with this simple design it is not possible to uncover said upper flap and said lower flap by folding them along the upper folding zone or lower folding zone respectively. Only a single flap needs to be provided with glue in order to obtain a packaging for collector cards that overcomes all the problems with the prior art while fulfilling all requirements for a suitable tamper safe packaging for collector cards.

According to an embodiment of the invention said limited number ranges from one to twenty five, for example from one to fifteen, preferably from one to ten.

According to a further embodiment of the invention said limited number of collector cards, when stacked, comprises a thickness of less than 10 mm, for example less than 8 mm, preferably less than 5 mm.

According to an embodiment of the invention said folding zone comprises at least one folding line.

A folding line can be easily implemented on the single sheet of material with during the conventional printing and/or processing of the single sheet of material. This allows the single sheet to be manufactured with conventional means.

According to a preferred embodiment of the invention said folding zone comprises a plurality of parallel folding lines.

This allow the packaging to be flexible as to the exact height of the stack of collector cards it should comprise. A plurality of folding lines will enable the packaging to adapt to this thickness of the stack of collector cards in an adaptive way. As such the package can be used for a range of said limited number of collector cards without the need to adapt the design of the single sheet of material it is manufactured from.

Optionally at least one extractable card is pre-printed on said single sheet of material. Optionally this least one extractable card comprises a perforated edge for extracting said at least one extractable card from said single sheet of material.

This allows for a combination of high quality collector cards, being sufficiently protected by the package, with some lower quality cards or items which can be integrated into the packaging itself and can thus be manufactured efficiently during the process of manufacturing the single sheet for the packaging by conventional printing and processing means.

According to an embodiment of the invention said single sheet of material is a single sheet of paper or cardboard. Preferably said single sheet of material is rigid enough such that it is not possible to extract said upper flap and said lower flap out of their cover formed by the first lateral flap and the second lateral flap without plastic deformation.

This results in an environmentally friendly, tamper proof, qualitative packaging for collector cards, that can be produced very efficiently, because the upper and lower flap are not required to be provided with glue.

According to a second aspect of the invention, there is provided a process for manufacturing said collector card packaging assembly according to the second aspect of the invention, characterised in that the manufacturing process comprises the following steps:

Moving the packaging for collector cards continuously along a transport direction substantially parallel to said first lateral side of said packaging for collector cards;

Folding the upper flap and lower flap towards said rectangular centre part along said upper and lower folding zone respectively until the angle between the upper flap and the centre part reaches an intermediate value and the angle between the lower flap and the centre part also reaches an intermediate value, said intermediate value being less than 180° and higher than 0°, preferable less than 120° and higher than 60°, for example 100°; placing one or more collector cards on top of said rectangular centre part Folding said upper flap and lower flap towards said rectangular centre part along said upper and lower folding zone respectively;

Subsequently folding said first lateral flap towards said centre part along said first lateral folding zone;

Providing glue to the side of said first lateral flap that faces away from said rectangular centre part;

Subsequently folding said second lateral flap towards said centre part along said second lateral folding zone such that said second lateral flap contacts said side of said first lateral flap provided with glue.

This manufacturing process allows for an increase in throughput as the not only there is no need to apply glue in a direction transverse to the transport direction, but also the collector cards while being introduced self align with the package in formation, which allows to decrease the need for precise synchronisation.

According to a preferred embodiment before placing one or more collector cards on top of said rectangular centre part, said first lateral flap is folded towards said rectangular centre part along said first lateral folding zone until the angle between the first lateral folding zone and the centre part reaches an intermediate value, said intermediate value being less than 180° and higher than 0°, preferable less than 120° and higher than 60°, for example 90°.

BRIEF DESCRIPTION OF THE DRAWINGS

FIG. 1 shows a single sheet of material for manufacturing a packaging for collector cards according to the invention; FIGS. 1A, 1B, 1C and 1D show schematically a partial cross section along the lines A-A, B-B, C-C and D-D in FIG. 1 respectively.

FIGS. 2 and 3 show two intermediate manufacturing steps performed on the single sheet of material shown in FIG. 1; FIGS. 2A, 2B, 2C and 2D and FIGS. 3A, 3B, 3C and 3D show partial cross sections for FIGS. 2 and 3 respectively along the lines A-A, B-B, C-C and D-D.

FIG. 4 shows a packaging for collector cards manufactured from the single sheet of material shown in FIG. 1; FIGS. 4A, 4B, 4C and 4D show schematically a partial cross section along the lines A-A, B-B, C-C and D-D in FIG. 4 respectively.

FIG. 6 shows a collector card packaging assembly according to the invention; FIGS. 6A, 6B, 6C and 6D show schematically a partial cross section along the lines A-A, B-B, C-C and D-D in FIG. 6 respectively.

FIG. 7 shows an intermediate manufacturing step for introducing a collector card into the packaging for collector cards for forming the collector card packaging assembly according to FIG. 6. FIGS. 7A, 7B, 7C and 7D show schematically a partial cross section along the lines A-A, B-B, C-C and D-D in FIG. 7 respectively.

DETAILED DESCRIPTION OF EMBODIMENT(S)

Figure 5:
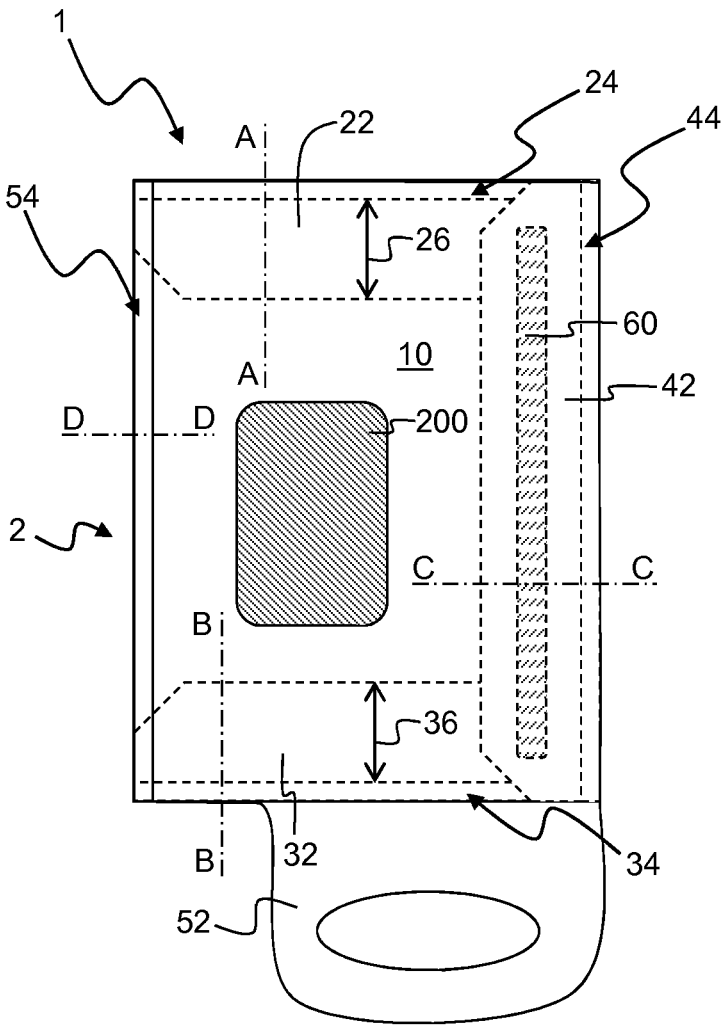
FIG. 5 shows an alternative embodiment of a packaging for collector cards according to FIG. 4.

FIG. 1 shows a single sheet of material 1 for manufacturing a packaging 2 for collector cards according to an embodiment of the invention shown in FIG. 4. This single sheet of material 1 is preferably a single sheet of suitable paper or cardboard, but alternatively also a suitable sheet of plastic is possible. The single sheet of material 1 comprises a rectangular centre part 10 with a width 12 and height 14 generally corresponding to the dimension of the collector cards which it is destined to hold. The circumference of this centre part 10 comprises an upper side 20, a lower side 30, a first lateral side 40 and a second lateral side 50. An upper flap 22 is connected to the upper side 20 by means of an upper folding zone 24, comprising four folding lines 100 parallel to the upper side 20. A lower flap 32 is connected to the lower side 30 of the centre part 10 by means of a lower folding zone 34, which comprises four folding lines 100 parallel to the lower side 30. A first lateral flap 42 is connected to the first lateral side 40 by means of a first lateral folding zone 44, which comprises four folding lines 100 parallel to the first lateral side 40. A second lateral flap 52 is connected to the second lateral side 50 by means of a second lateral folding zone 54, comprising four folding lines 100 parallel to the second lateral side 50.

In this particular embodiment the folding zones 24, 34, 44, 54 each comprise four folding lines 100 parallel to the respective sides 20, 30, 40, 50 of the centre part 10. These folding lines 100 can be for example formed as a longitudinal pre-formed recess or nudge parallel to the sides 20, 30, 40, 50. According to alternative embodiments the respective folding zones 24, 34, 44, 54 could comprise one or more such folding lines 100 as will be explained further below.

Generally the folding zones 24, 34, 44, 54 are formed such that they allow the respective flaps 22, 32, 42, 52 to be folded along an axis parallel to the respective side 20, 30, 40, 50 of the centre part 10. As shown in the partial cross sections of FIGS. 1A-1D this allows the respective angles 25, 35, 45, 55 between the respective flaps 22, 32, 42, 52 and the centre piece 10 to be set to a predetermined value. The centre piece 10 and the respective flaps 22, 32, 42, 52 being rigid enough such that when manipulated they tend to fold along the more flexible folding zones 24, 34, 44, 54 respectively. In this way it will not be possible to extract the upper or lower flap from the packaging 2 for collector cards as shown in FIG. 4 without plastic deformation of these flaps 22, 32, as explained further below.

As indicated in FIG. 1, each of the respective flaps 22, 32, 42, 52 comprises a respective dimension which will be referred to as their depth 26, 36, 46, 56 generally along a direction orthogonal to their corresponding side 20, 30, 40, 50 of the centre part 10. Each of the respective folding zones 24, 34, 44, 54 also comprises a respective dimension which will be referred to as their depth 28, 38, 48, 58 generally along a direction orthogonal to their corresponding side 20, 30, 40, 50 of the centre part 10.

FIG. 1 shows the single sheet of material 1 for manufacturing the packaging 2 for collector cards according to an embodiment of the invention as shown in FIG. 4 before the first step of its manufacturing process. In this state of the single sheet of material 1 the respective angles 25, 35, 45, 55 between the respective flaps 22, 32, 42, 52 is approximately 180°. This can for example be the state of the single sheet of material 1 after being printed on a printing and/or processing machine which is for example also suitable for printing and processing the collector cards.

In a first manufacturing step for forming the embodiment of the packaging 2 for collector cards the upper flap 22 and lower flap 32 are folded towards the rectangular centre part 10 along said upper folding zone 24 and lower folding zone 34 respectively. During folding, the angle 25 between the upper flap 22 and the rectangular centre part 10 will be reduced from about 180° to about 0°, and the angle 35 between the lower flap 32 and the rectangular centre part 10 will also be reduced from about 180° to about 0°, this means both the upper flap 22 and the lower flap 32 are folded over an angle of about 180°. At the end of this manufacturing step the single sheet of material 1 reaches the state as shown in FIG. 2 and the corresponding cross sections shown in FIGS. 2A, 2B, 2C and 2D.

During a subsequent manufacturing step also the first lateral flap 42 is folded towards the centre part 10 along its first lateral folding zone 44 until the single sheet of material 1 reaches the configuration as shown in FIG. 3 and the corresponding cross sections shown in FIGS. 3A, 3B, 3C and 3D. The angle 45 between this first lateral folding zone 44 and the centre part also being reduced from about 180° to about 0°. As shown in FIG. 3 glue 60 is provided to the side 48 of the first lateral flap 42 that faces away from the rectangular centre part 10. This glue or other suitable adhesive stretches out generally parallel to the first lateral side 40 of the centre part. It can be applied after the first lateral flap 42 was folded onto the centre part 10, but alternatively it could also be a strip of glue that was already applied during the manufacturing process of the single piece of material 1.

Subsequently the second lateral flap 52 is folded towards the centre part 10 along the second lateral folding zone 54. As shown in FIG. 4 and the corresponding cross sections of FIGS. 4A, 4B, 4C and 4D the angle 55 between the second lateral flap 52 and the centre part is also being reduced from about 180° to about 0°. In that way the second lateral flap 52 contacts the side 48 of the first lateral flap provided with glue 60 and as such is affixed to it.

It is essential that the first lateral flap 42 and the second lateral flap 52 are dimensioned such that, when folded on said centre part 10 as shown in FIG. 4, they are able to cover said centre part 10 entirely in order to obtain a package 2 for collector cards that is able to enclose the collector cards entirely.

It is further essential that the upper flap 22 and the lower flap 32 are dimensioned in such a way that, when they are covered by the first lateral flap 42 and the second lateral flap 52, it is no longer possible to uncover the upper flap 22 and the lower flap 32 by folding them along the upper folding zone 24 or lower folding zone 34 respectively. In this way the upper flap 22 and lower flap 32, although not provided with glue or any other suitable adhesive, can form a tamper proof enclosure for the collector cards as it will not be possible to extract the upper flap 22 and lower flap 32 out of their cover formed by the first lateral flap 42 and the second lateral flap 52 without plastic deformation. Preferably the single sheet of material 1 is rigid enough, in the regions excluding the folding zones, such that it is not possible to extract said upper flap 22 and said lower flap 32 out of their cover formed by the first lateral flap 42 and the second lateral flap 52 without plastic deformation. Removing the upper flap 22 or lower flap 32 as such would be difficult to accomplish and would inevitably cause damage to the upper or lower flap, which would form an indication that the package has already been opened before. In order to accomplish this, as shown in the embodiment of FIGS. 1 to 4 the depth 26, 36 of the upper and lower flap 22, 32 exceeds the depth 28, 38 of the upper and lower folding zone 24, 34 respectively.

In this particular embodiment the folding zone 24 comprises four folding lines 100 parallel to the upper side 20, which could be for example a longitudinal pre-formed recess or nudge parallel to the upper side 20. According alternative embodiments this folding zone 24 could comprise one or more such folding lines 100. A folding zone 24 comprising a single folding line 100 would be suited for a limited number of collector cards, for example 1 to 5. A folding zone 24 with a plurality of folding lines 100 has the advantage that the packaging 2 for collector cards can be used for a range of the number of collector cards that must not be known beforehand as the number of folding lines 100 of the folding zone 24 being used during folding will adapt to the height of the stack of collector cards within the packaging 2.

Optionally according to an alternative embodiment shown in FIG. 5 one or more extractable cards 200 can be preprinted on the single sheet of material 1, preferably comprising a perforated edge for easy extraction the single sheet of material 1. These extractable cards, could for example be cards of lower value in the context of the collector cards. According to further alternative embodiments there could be provided a plurality of such extractable cards 200 and according to still further alternatives these extractable cards 200 could comprises an arbitrary shape which diverges from a conventional rectangular card shape, such shapes could for example be similar to a puzzle piece, round or oval shapes or any other suitable shape.

When the packaging 2 for collector cards is filled with one or more collector cards there is formed a collector card packaging assembly as shown in FIG. 6 and the corresponding cross sections in FIGS. 6A, 6B, 6C and 6D. This collector card packaging assembly according to the invention allows a limited number of collector cards 300 of suitable dimensions that do not exceed those of the rectangular centre part 10 to be enclosed securely and tamper proof within said packaging. This limited number of collector cards 300 is then positioned on top of the centre part 10 and below the upper flap 22, the lower flap 32, the first lateral flap 42 and the second lateral flap 52. The number of collector cards 300 is limited in that it ranges from one to twenty five, for example from one to fifteen, preferably from one to ten, such that when stacked this limited number of collector cards 300 comprises a thickness of less than 10 mm, for example less than 8 mm, preferably less than 5 mm.

A preferred process for manufacturing the collector card packaging assembly as shown in FIG. 6 will now be explained in more detail. In order to efficiently and reliably place one or more collector cards 300 on top of said rectangular centre part 10, especially when the manufacturing process makes use of a continuous manufacturing line the upper flap 22 and lower flap 32 are used as guides for aligning the collector cards being introduced onto the centre part. This is accomplished by manufacturing step, before the introduction of the one or more collector cards 300 in which the upper flap 22 and lower flap 32 are folded towards the rectangular centre part 10 along the upper and lower folding zone respectively. However the upper flap 22 is only folded until the angle 25 between the upper flap 22 and the centre part 10 reaches an intermediate value. Also the lower flap is only folded until the angle 35 between the lower flap 32 and the centre part 10 reaches an intermediate value. This intermediate value should be less than 180° and higher than 0°, but in order to have good clearance for placing the collector cards onto the rectangular centre part 10, while at the same time retaining a sufficient angel to accomplish the effect that the intermediately folded upper flap 22 and lower flap 32 will align the collector cards 300 onto the centre part 10 by means of gravity, this intermediate value is preferable less than 120° and higher than 60°, for example 90° or 100°, as shown in FIG. 7. Subsequently placing one or more collector cards 300 on top of said rectangular centre part 10 will be possible with some degree of tolerance for alignment of the collector cards 300 to the rectangular centre part 10. As explained before with reference to FIGS. 1 to 4 the manufacturing process for the packaging 2 can be completed by folding said upper flap 22 and lower flap 32 towards said rectangular centre part 10 along said upper and lower folding zone respectively such that the respective angles 25, 35 approaches 0°. Subsequently folding the first lateral flap 42 towards the centre part 10 along the first lateral folding zone 44, the angle 45 also approaching 0°. Providing glue 60 to the side 48 of the first lateral flap that faces away from said rectangular centre part (10). Subsequently the second lateral flap 52 is folded towards the centre part 10 along the second lateral folding zone 54 such that the second lateral flap 52 contacts the side 48 of the first lateral flap 42 provided with glue 60.

According to a preferred embodiment, as shown in FIG. 7 and the corresponding cross section of FIGS. 7A, 7B, 7C and 7D, before placing the one or more collector cards 300 on top of the rectangular centre part 10, also the first lateral flap 42 is folded towards said rectangular centre part 10 along said first lateral folding zone 44 until the angle 45 reaches such an intermediate value. Still according to the further preferred embodiment as shown in FIG. 7, also the second lateral flap 52 is folded until the angle 55 reaches such an intermediate value. Now collector cards 300 placed on the rectangular centre part 10 during the manufacturing process while the packaging 2 moves continuously along a transport direction F substantially parallel to the first lateral side 20 of said packaging 2 for collector cards as shown in FIG. 7, will align themselves to the rectangular centre part 10 automatically under influence. As such the manufacturing process is able to attain a much higher throughput then prior art manufacturing process because it is inherently able to compensate for variations in the synchronisation and misalignment of the collector cards 300 with respect to their packaging 2 during such a high speed manufacturing process. Furthermore the manufacturing process only requires to apply glue 60 to a single lateral flap 42 in such a way that the glue 60 can be applied for example from a fixed location while the packaging 2 moves past the glue applying apparatus along its transport direction F. As such there is no need any more for sealing operations that are to be performed transverse to the transport direction F, which advantageously decreases the need for synchronisation of the sealing operation and allows for an unprecedented throughput.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfill the functions of several means recited in the claims. Any reference signs in the claims shall not be construed as limiting the respective claims concerned. The terms "first", "second", "third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A collector card packaging assembly comprising a packaging for collector cards, manufactured from a single sheet of material comprising:

a rectangular centre part with a circumference comprising an upper side, a lower side, a first lateral side and a second lateral side;

an upper flap connected to said upper side by means of an upper folding zone;

a lower flap connected to said lower side by means of a lower folding zone;

a first lateral flap connected to said first lateral side by means of a first lateral folding zone; and a second lateral flap connected to said second lateral side by means of a second lateral folding zone, said upper flap and lower flap being folded towards said rectangular centre part along said upper and lower folding zone respectively, said first lateral flap being folded towards said centre part along said first lateral folding zone, glue being provided to the side of said first lateral flap that faces away from said rectangular centre part, said second lateral flap being folded towards said centre part along said second lateral folding zone such that said second lateral flap contacts said side of said first lateral flap provided with glue, said first lateral flap and said second lateral flap being dimensioned such that, when folded on said centre part, they cover said centre part entirely, and said upper flap and said lower flap not being provided with glue and said upper flap and said lower flap being dimensioned such that the depth of said upper and lower flap exceeds the depth of said upper and lower folding zone respectively, wherein the collector card packaging assembly further comprises a limited number of collector cards, dimensioned and enclosed within said packaging such that said limited number of collector cards is positioned on top of said centre part and below said upper flap, said lower flap, said first lateral flap and said second lateral flap, wherein at least one extractable card is pre-printed on said single sheet of material, and wherein said at least one extractable card comprises a perforated edge for extracting said at least one extractable card from said single sheet of material.

2. A collector card packaging assembly according to claim 1, wherein said limited number of collector cards ranges from one to twenty five.

3. A collector card packaging assembly according to claim 1, wherein said limited number of collector cards, when stacked, comprises a thickness of less than 10 mm.

4. A collector card packaging assembly according to claim 1, wherein said upper folding zone, lower folding zone, first lateral folding zone, and second lateral folding zone each comprises at least one folding line.

5. A collector card packaging assembly according to claim 1, wherein said upper folding zone, lower folding zone, first lateral folding zone, and second lateral folding zone each comprises a plurality of parallel folding lines.

6. A collector card packaging assembly according to claim 1, wherein said at least one extractable card comprises an arbitrary shape.

7. A collector card packaging assembly according to claim 1, wherein said single sheet of material is a single sheet of paper or cardboard.

8. A collector card packaging assembly according to claim 1, wherein said single sheet of material is rigid enough such that it is not possible to extract said upper flap and said lower flap out of their cover formed by the first lateral flap and the second lateral flap without plastic deformation.

9. A collector card packaging assembly according to claim 1, wherein:

said upper flap and lower flap being folded towards said rectangular centre part along first folding lines of said upper and lower folding zone respectively, until an intermediate angle between the upper flap and the rectangular centre part reaches a value that is less than 120° and higher than 60° and an intermediate angle between the lower flap and the rectangular centre part reach a value that is less than 120° and higher than 60°;

the intermediate angle of the upper flap and lower flap has sufficient clearance for placing the limited number of collector cards on the rectangular centre part while still retaining a sufficient angle for the upper flap and the lower flap to align the limited number of collector cards on the rectangular centre part by means of gravity, and an act of placing the limited number of collector cards on top of said rectangular centre part is possible with some degree of tolerance for alignment of the limited number of collector cards to the rectangular centre part;

after placing the limited number of collector cards on top of said rectangular centre part, the upper flap and the lower flap being folded towards said rectangular centre part along second folding lines of said upper and lower folding zones respectively until the angle between the upper flap and the rectangular centre part and the angle between the lower flap and the rectangular centre part reach a value that approaches 0°, and the first lateral flap being folded towards the rectangular centre part along a first folding line of the first lateral folding zone and the angle between the first lateral flap and the rectangular centre part reaches a value that approaches 0°;

glue being provided to the side of said first lateral flap that faces away from said rectangular centre part, said second lateral flap being folded towards said rectangular centre part along said second lateral folding zone such that said second lateral flap contacts said side of said first lateral flap provided with glue, said first lateral flap and said second lateral flap being dimensioned such that, when folded on said rectangular centre part, they cover said rectangular centre part entirely, and said upper flap and said lower flap being dimensioned such that the depth of said upper and lower flap exceeds the depth of said upper and lower folding zone respectively, wherein the collector card packaging assembly further comprises the limited number of collector cards, dimensioned and enclosed within said packaging such that said limited number of collector cards is positioned on top of said rectangular centre part and below said upper flap, said lower flap, said first lateral flap and said second lateral flap.

10. The collector card packaging assembly according to claim 9, wherein the first folding lines of the upper and lower folding zones are the same as the second folding lines of the upper and lower folding zones.

11. The collector card packaging assembly according to claim 9, wherein the first folding lines of the upper and lower folding zones have a proximity that is closer to outer edges of the upper and lower flaps than the second folding lines of the upper and lower folding zones.

12. The collector card packaging assembly according to claim 9, wherein before placing the limited number of collector cards on top of said rectangular centre part, said first lateral flap is folded towards said rectangular centre part along an intermediate folding line of said first lateral folding zone until an intermediate angle between the lateral flap and the rectangular centre part reaches a value that is less than 120° and higher than 60°.

13. The collector card packaging assembly according to claim 1, wherein glue is only provided to said first lateral flap.

14. A process for manufacturing said collector card packaging assembly according to claim 1, wherein the manufacturing process comprises the following steps:

moving the packaging for collector cards continuously along a transport direction substantially parallel to said first lateral side of said packaging for collector cards;

folding the upper flap and lower flap towards said rectangular centre part along said upper and lower folding zone respectively until the angle between the upper flap and the centre part reaches an intermediate value and the angle between the lower flap and the centre part also reaches an intermediate value, said intermediate value being less than 180° and higher than 0°;

placing said limited number of collector cards on top of said rectangular centre part;

folding said upper flap and lower flap towards said rectangular centre part along said upper and lower folding zone respectively;

subsequently folding said first lateral flap towards said centre part along said first lateral folding zone;

providing said glue to the side of said first lateral flap that faces away from said rectangular centre part;

subsequently folding said second lateral flap towards said centre part along said second lateral folding zone such that said second lateral flap contacts said side of said first lateral flap provided with glue, wherein during the process for manufacturing said collector card packaging assembly no glue is provided to said upper flap and said lower flap, Wherein at least one extractable card is pre-printed on said single sheet of material, and Wherein said at least one extractable card comprises a perforated edge for extracting said at least one extractable card from said single sheet of material.

15. A process for manufacturing said collector card packaging assembly according to claim 14, wherein before placing said limited number of collector cards on top of said rectangular centre part, said first lateral flap is folded towards said rectangular centre part along said first lateral folding zone until the angle between the first lateral folding zone and the centre part reaches an intermediate value, said intermediate value being less than 120° and higher than 60°.

16. A process for manufacturing said collector card packaging assembly according to claim 14, wherein during manufacturing process said packaging for collector cards is continuously moved along a transport direction substantially parallel to the first lateral side of said packaging for collector cards.

17. A process for manufacturing said collector card packaging assembly according to claim 14, wherein during the process for manufacturing said collector card packaging assembly only glue is provided to said first lateral flap.

18. A collector card packaging assembly comprising a packaging for collector cards, manufactured from a single sheet of material comprising:

a rectangular centre part with a circumference comprising an upper side, a lower side, a first lateral side and a second lateral side;

an upper flap connected to said upper side by means of an upper folding zone;

a lower flap connected to said lower side by means of a lower folding zone;

a first lateral flap connected to said first lateral side by means of a first lateral folding zone; and a second lateral flap connected to said second lateral side by means of a second lateral folding zone, said upper flap and said lower flap being folded towards said rectangular centre part along said upper and lower folding zone respectively, said first lateral flap being folded towards said rectangular centre part along said first lateral folding zone, glue being provided to the side of said first lateral flap that faces away from said rectangular centre part, said second lateral flap being folded towards said rectangular centre part along said second lateral folding zone such that said second lateral flap contacts said side of said first lateral flap provided with said glue, said first lateral flap and said second lateral flap being dimensioned such that, when folded on said rectangular centre part, they cover said rectangular centre part entirely, and said upper flap and said lower flap being dimensioned such that the depth of said upper and lower flap exceeds the depth of said upper and lower folding zone respectively, wherein the collector card packaging assembly further comprises a limited number of collector cards, dimensioned and enclosed within said packaging such that said limited number of collector cards is positioned on top of said rectangular centre part and below said upper flap, said lower flap, said first lateral flap and said second lateral flap, wherein said upper flap and said lower flap are not provided with glue and said single sheet of material is sufficiently rigid such that it is not possible to extract said upper flap and said lower flap out of a cover formed by the first lateral flap and the second lateral flap without plastic deformation of said upper flap or said lower flap, wherein at least one extractable card is pre-printed on said single sheet of material, and wherein said at least one extractable card comprises a perforated edge for extracting said at least one extractable card from said single sheet of material.

19. The collector card packaging assembly according to claim 18, wherein glue is only provided to said first lateral flap.

* * * * *